United States Patent [19]

Barozzi et al.

[11] 4,456,395

[45] Jun. 26, 1984

[54] PLATEN KNOB DEVICE OF TYPEWRITER

[75] Inventors: Gian P. Barozzi; Giancarlo Horeschi, both of Tokyo, Japan

[73] Assignee: Tokyo Juki Industrial Co., Ltd., Tokyo, Japan

[21] Appl. No.: 549,630

[22] Filed: Nov. 7, 1983

Related U.S. Application Data

[63] Continuation of Ser. No. 280,020, Jun. 30, 1981, abandoned.

[30] Foreign Application Priority Data

Jul. 10, 1980 [JP] Japan ..... 55-94520

[51] Int. Cl.[3] ..... B41J 19/96

[52] U.S. Cl. ..... 400/559.1; 400/556.2

[58] Field of Search ..... 400/556, 556.1, 556.2, 400/556.3, 556.4, 557, 558, 559, 559.1, 560, 560.1, 560.2, 561

[56] References Cited

U.S. PATENT DOCUMENTS

| | | | |
|---|---|---|---|
| 658,157 | 9/1900 | Merritt | 400/556.3 |
| 720,762 | 2/1903 | Walker | 400/559 |
| 791,549 | 6/1905 | Grosbois | 400/559.1 |
| 855,532 | 6/1907 | Ruger, Jr. | 400/559.1 |
| 925,422 | 6/1909 | Burns et al. | 400/560.2 |
| 1,165,547 | 12/1915 | Sholes | 400/559.1 |
| 1,831,955 | 11/1931 | Harney | 400/556.2 |
| 4,247,212 | 1/1981 | Wu | 400/559.1 X |

OTHER PUBLICATIONS

IBM Selectric Typewriter Service Manual, May 1975, IBM Corp., pp. 145, 149.

*Primary Examiner*—Edgar S. Burr
*Assistant Examiner*—Charles A. Pearson
*Attorney, Agent, or Firm*—Koda and Androlia

[57] ABSTRACT

This invention is a platen knob device in a typewriter for releasing a platen of the typewriter from a platen pitch feed mechanism and changing the platen over to a continuous feed. This platen knob device includes a platen variable fixed onto a platen shaft and a platen driver operative in association with the platen pitch feed mechanism and slidably provided on the platen shaft. The platen driver is urged by the platen variable through a spring, whereby the platen driver and the platen variable are engaged with each other, in which condition, if the platen knob is rotated, then the platen is changed over to the pitch feed. If the platen knob is urged in a direction opposite to the direction in which the platen knob is urged by the spring, then the platen driver is urged against an end face of a cylindrical portion of the platen knob to move in the axial direction thereof and separated from the platen variable to change the platen over to the continuous feed.

1 Claim, 3 Drawing Figures

PLATEN KNOB DEVICE OF TYPEWRITER

This is a continuation of application Ser. No. 280,020, filed June 30, 1981, now abandoned.

BACKGROUND OF THE INVENTION

1. Field of the Invention

The present invention relates to platen knob devices of typewriters, and more particularly to a variable platen knob device for releasing a platen knob from a platen pitch feed mechanism.

2. Description of the Prior Art

As well known, a variable platen knob device has been provided on a typewriter for releasing a platen from a platen pitch feed mechanism provided on a platen knob and changing the platen over to a continuous feed. This variable platen knob device is used when a typewriter paper which has been typewritten and removed from the typewriter is inserted into the typewriter again and restored to the original typing line for addition or correction. Heretofore, there have been proposed various variable platen knob devices in the typewriters, however, every platen knob devices have presented a disadvantage of having complicated construction.

SUMMARY OF THE INVENTION

The present invention has been developed to obviate the above described disadvantage of the variable platenknob devices of the conventional typewriters and has as its object the provision of a platen knob device of a typewriter, wherein, in a simplified construction, a platen is released from a platen pitch feed mechanism and changed over to a platen continuous feed.

To achieve the abovedescribed object, the present invention has such characteristic features that the platen knob device comprises: a first clutch member having engageable surfaces and fixed onto a platen shaft; a second clutch member having a surface engageable with the engageable surfaces of the first clutch member and teeth constituting a platen pitch feed mechanism and axially slidably mounted on the platen shaft; a resilient member for urging the engageable surface of the second clutch member against the engageable surfaces of the first clutch member; a platen knob axially slidably mounted on the platen shaft, the end face of a cylindrical portion of which is extended to a position close to the second clutch member; and an opening portion formed in the cylindrical portion of the platen knob, into which part of the first clutch member is coupled, with a clearance corresponding to an axial movement of the platen knob being left; whereby an urging force in a direction opposite to the direction in which the platen knob is urged by the resilient member is rendered to the platen knob, so that the engageable surfaces of the first clutch member are separated from the engageable surface of the second clutch member to change the platen over to a platen continuous feed, or, the urging force to the platen knob is released, so that the engageable surfaces of the first clutch member can be engaged with the engageable surface of the second clutch member to change the platen over to a platen pitch feed.

BRIEF DESCRIPTION OF THE INVENTION

The abovedescribed and other objects, features and advantages of the present invention will become apparent more fully from the description of the following embodiment in conjunction with the accompanying drawings.

DETAILED DESCRIPTION OF THE INVENTION

Figure 1:
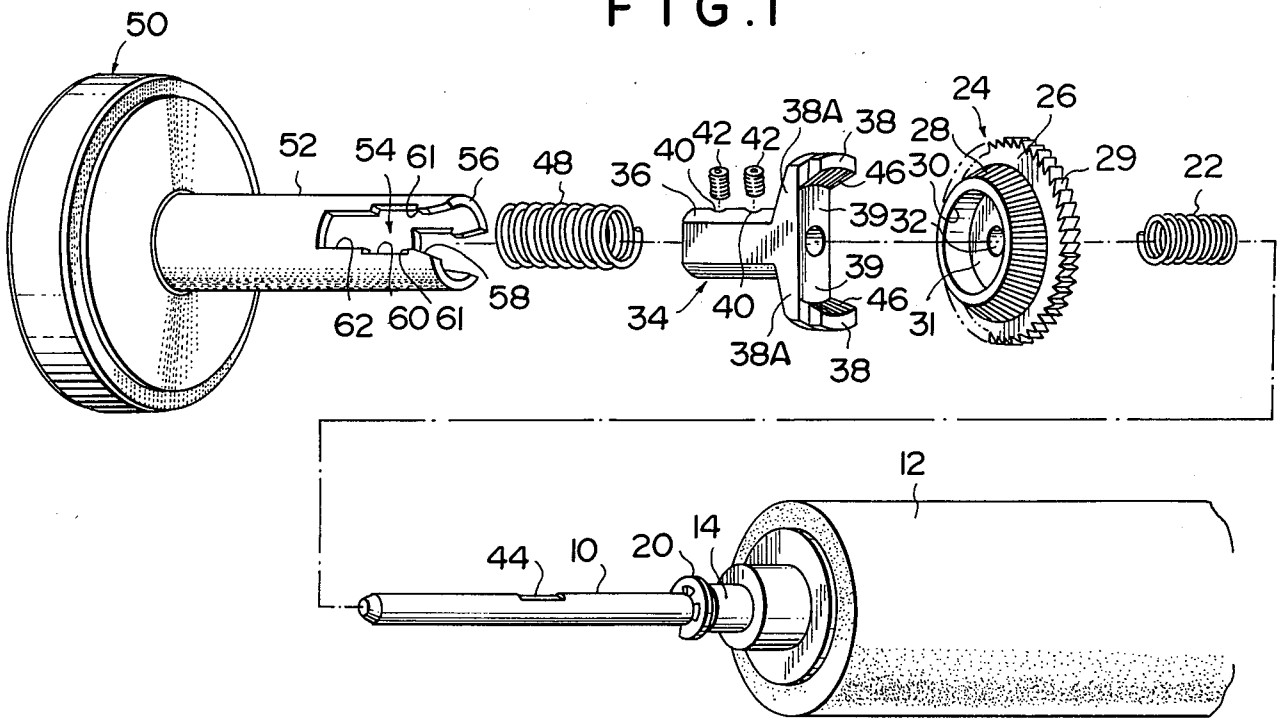
FIG. 1 is a disassembled perspective view showing construction of an embodiment according to the present invention.

Referring to FIG. 1, a platen shaft 10 shows the left side portion thereof, and a platen 12 shown in the right in the drawing is solidly secured to the platen shaft 10 through screws, not shown. Pivotally supported on the platen shaft 10 is a bush 14, which is placed on a frame of the typewriter, not shown, when the platen 12 is set on the typewriter to rotatably support the platen shaft 10 with respect to the frame of the typewriter. A circumferential groove, not shown, is cuttingly provided on the platen shaft 10 at a portion leftwardly of the bush 14, and a snap ring 20 is engaged with this groove. This snap ring 20 engaged with the groove on the platen shaft 10 fulfills a function as one of spring receivers for a spring 22. Namely, the spring 22 is confined between the snap ring 20 and a platen driver 24 constituting a second clutch member, slidably mounted on the platen shaft 10 to urge the platen driver 24 upwardly and leftwardly in FIG. 1.

The platen driver 24 constituting the second clutch member comprises a disk portion 26 and a conical portion 28 formed at the left side surface of the disk portion, and teeth 29 are formed on the outer periphery of the disk portion 26. These teeth 29 are engaged with a ratchet of a platen pitch feed mechanism, not shown, to make possible the pitch feed of the platen 12. Knurling is provided on the surface of the conical portion 28 of the platen driver 24 to form a concavoconvex surface as shown in the drawing, and a recess 30 being circular in cross section is formed inside the conical portion 28. This recess 30 receives the end face of a cylindrical portion of a platen knob to be described hereinafter. A through-hole 32 is formed in the center of the platen driver 24, and the platen shaft 10 is inserted through this through-hole 32, so that the platen driver 24 can slidably movable in the axial direction of the platen shaft 10.

A platen variable 34 constituting a first clutch member is fixed on the platen shaft 10 at a portion leftwardly of the platen driver 24. As shown, the platen variable 34 comprises a flattened cylindrical portion 36, and two pawls 38 and 38 which are bifurcated from the flattened cylindrical portion 36. Screws 42 and 42 are threaded through threaded holes 40 and 40 formed in the upper surface of the flattened cylindrical portion 36 and brought into abutting contact with the flat portion 44 of the platen shaft 10, whereby the platen variable 34 is solidly secured to the platen shaft 10. Inner surfaces of the pawls 38 and 38 of the platen variable 34 are formed to provide curved surfaces 46 to meet with the surfaces of the conical portion 28 of the platen driver 24, and these curved surfaces 46 are each provided with knurling in the same manner as the conical portion 28 to form concavo-convex surface. Consequently, if the platen driver 24 is urged by the spring 22 to the left in the drawing whereby the conical portion 28 is engaged with the curved surfaces 46 of the platen variable 34, then both members are engaged with each other and rotated integrally, so that the platen 12 can be pitch-fed by the pitch feed mechanism of the platen driver 24. If the platen driver 24 is urged to the right in the drawing against the resilient force of the spring 22, then the platen driver 24 is disengaged from the platen variable 34, so that the platen 12 can be released and continuously fed.

A platen knob 50 is axially slidably mounted on the platen shaft 10 at a portion leftwardly of the platen variable 34. Namely, the flattened cylindrical portion 36 of the platen variable 34 is fixed on the platen shaft 10 is inserted into a cylindrical portion 52 of the platen knob 50, which is slidable in the axial direction of the shaft 10. As shown, formed in the cylindrical portion 52 of the platen knob 50 are openings 54, into which proximal end portions 38A and 38A of the pawls 38 and 38 of the platen variable 34 are coupled with a predetermined value of clearance being left. More specifically, the openings 54 are formed such that they start from an end face 56 of the cylindrical portion 52 of the platen knob 50 as flared portions 58, further, square portions 60 are disposed contiguously to the flared portions 58. The flared portions 58 and the square portions 60 are formed in diametrically opposed positions on the cylindrical portion 52. A rectangular portion 62 is disposed contiguously to one of the square portions 60. The flared portions 58 of the cylindrical portion 52 are formed to facilitate the coupling of the proximal end portions 38A and 38A of the pawls 38 and 38 of the platen variable 34 when the proximal end portions 38A and 38A are coupled into the openings 54, and further, the proximal end portions 38A of the pawls 38 of the platen variable 34 are received in the square portions 60 with a certain value of clearance in the axial direction of the platen shaft 10 being left at positions where the proximal end portions 38A of the pawls 38 are disposed, so that the platen knob 50 can move by the value of clearance with respect to the platen shaft 10. Furthermore, the rectangular portion 62 contiguous to the square portion 60 is disposed upwardly of the threaded holes 40 when the platen knob 50 is assembled to the platen variable 34, so that the screws 42 can be threaded into the threaded holes 40 of the platen variable 34 through the rectangular portion 62 when the platen variable 34 is assembled.

As described above, the proximal end portions 38A of the pawls 38 of the platen variable 34 each have allowances in movement corresponding to a movement of the platen knob 50 in the square portion 60. However, right end faces 39 of the pawls 38 are brought into abutting contact with right side edge portions 61 of the square portions 60 by the urging force of the spring 48, so that loosenesses between the pawls 38 and the square portions 60 by the value of clearance can be eliminated. An end face 56 of the platen knob 50 is disposed in the recess 30 of the platen driver 24 and close to an end face 31 of the platen driver 24 when the proximal end portions 38A of the pawls 38 of the platen variable 34 are inserted into the square portions 60.

Figure 2:
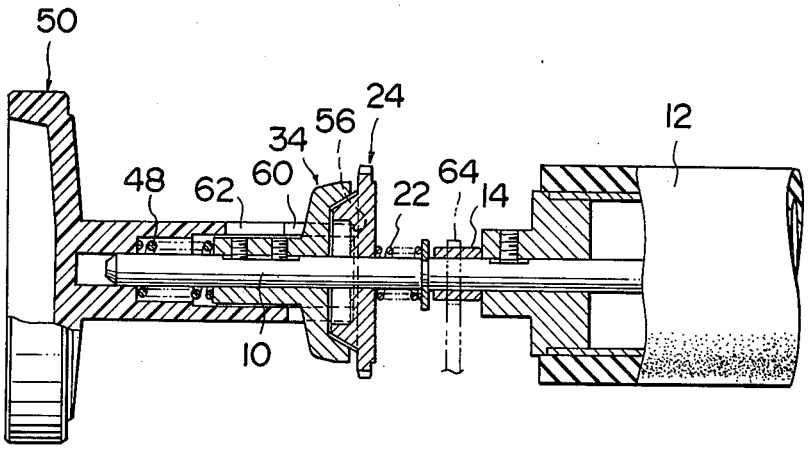
FIG. 2 is a sectional view showing the state of platen pitch feed in the embodiment of the present invention.

FIG. 2 is a sectional view showing construction of the platen knob device, into which the component members with the abovedescribed arrangement in the embodiment of the present invention. In the state shown in FIG. 2, the platen driver 24 is urged against the platen variable 34 by the resilient force of the spring 22, whereby the platen driver 24 and the platen variable 34 are engaged with each other, so that both members can integrally rotated. Consequently, in this state, if the platen knob 50 is rotated, then the platen 12 is pitch-fed by the pitch feed mechanism of the platen driver 24.

Figure 3:
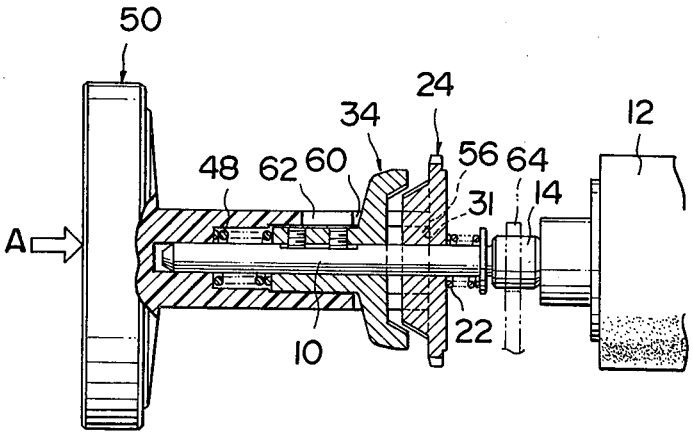
FIG. 3 is a sectional view showing the state of platen continuous feed in the embodiment of the present invention.

If an urging force is applied to the platen knob 50 in a direction indicated by an arrow A in FIG. 3 in the state shown in FIG. 2 then the platen driver 24 is disengaged from the platen variable 34. More specifically, in the state shown in FIG. 2, the cylindrical end face 56 of the platen knob 50 is disposed at a position close to the platen driver 24. In this state, if the platen knob 50 is pushed in the direction indicated by the arrow A in FIG. 3 against the resilient force of the spring 48, then the cylindrical end face 56 of the platen knob 50 abuts against the end face 31 of the platen driver 24. If the platen knob 50 is further pushed in the direction indicated by the arrow A, then the platen driver 24 is moved by the cylindrical end face 56 to the right in the drawing against the urging force of the spring 22, whereby the platen driver 24 is disengaged from the platen variable 34. In this state, if the platen knob 50 in rotated, then the platen knob 50 is released from the platen pitch feed mechanism provided on the platen driver 24, so that the platen 12 can be continuously fed. In addition, a member designated at 64 in FIGS. 2 and 3 is part of the frame of the typewriter for supporting a bush 14.

As has been described hereinabove, by use of the platen knob device of the typewriter according to the present invention, in a simplified construction, the platen can be released from the platen pitch feed mechanism and changed over to the platen continuous feed.

It should be apparent to one skilled in the art that the abovedescribed embodiment is merely illustrative of but a few of the many possible specific embodiments of the present invention. Numerous and varied other arrangements can be readily devised by those skilled in the art without departing from the spirit and scope of the invention.

What is claimed is:

1. A platen knob device of a typewriter, comprising:

a first clutch member having two pawls having on a periphery thereof engageable surfaces, said first clutch member being fixed onto a platen shaft;

a second clutch member having a surface engageable with the engageable surfaces of the first clutch member and teeth constituting a platen pitch feed mechanism, said second clutch member axially slidably mounted on the platen shaft;

a first resilient member for urging the engageable surface of the second clutch member against the engageable surfaces of the first clutch member;

a platen knob axially slidably mounted on the platen shaft and having a cylindrical portion bottomed at a base thereof, said cylindrical portion being formed with square openings through which proximal portions of said two pawls transeversely extend, an end face of said cylindrical portion being opposite to said second clutch member;

a second resilient member interposed between said platen knob and said first clutch member and for axially urging outwardly said platen knob so that said proximal portions are abutted on right edges of said openings and axial clearance corresponding to axial movement of said platen knob is defined between each proximal portion and each left edge of said square openings; whereby said platen knob is capable of displacing by said axial clearance and the axial displacement of said platen knob causes said second clutch member to disengage from said first clutch member for continuous rotation of said platen.

* * * * *